US007254867B2

(12) United States Patent
Legatt et al.

(10) Patent No.: US 7,254,867 B2
(45) Date of Patent: Aug. 14, 2007

(54) SQUEEGEE ASSEMBLY

(75) Inventors: Donald Joseph Legatt, St. Michael, MN (US); Nick Graupe, White Bear Lake, MN (US); Charles A. Cazett, Hopkins, MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 599 days.

(21) Appl. No.: 10/795,657

(22) Filed: Mar. 8, 2004

(65) Prior Publication Data

US 2005/0115015 A1 Jun. 2, 2005
US 2006/0143855 A9 Jul. 6, 2006

Related U.S. Application Data

(60) Provisional application No. 60/453,007, filed on Mar. 7, 2003.

(51) Int. Cl.
*A47L 11/30* (2006.01)

(52) U.S. Cl. ..... 15/401; 15/322

(58) Field of Classification Search ..... 15/320–322, 15/401, 402
See application file for complete search history.

(56) References Cited

U.S. PATENT DOCUMENTS

| | | | | |
|---|---|---|---|---|
| 1,849,663 | A | 3/1932 | Finnell | |
| 2,989,769 | A | 6/1961 | Houser | |
| 3,019,462 | A | 2/1962 | Nash et al. | |
| 3,571,841 | A * | 3/1971 | Crouser | 15/401 |
| 3,872,540 | A | 3/1975 | Block | |
| 3,992,747 | A | 11/1976 | Hufton | |
| 4,006,506 | A | 2/1977 | Burgoon | |
| 4,037,289 | A | 7/1977 | Dojan | |
| 4,041,567 | A | 8/1977 | Burgoon | |
| 4,138,759 | A | 2/1979 | Voorhees | |
| 4,200,951 | A | 5/1980 | Burgoon et al. | |
| 4,293,971 | A | 10/1981 | Block | |
| 4,363,152 | A | 12/1982 | Karpanty | |
| 4,483,041 | A | 11/1984 | Waldhauser et al. | |
| 4,492,002 | A | 1/1985 | Waldhauser et al. | |
| 4,805,256 | A | 2/1989 | Mason et al. | |
| 4,817,233 | A | 4/1989 | Waldhauser | |
| 4,937,911 | A | 7/1990 | Picchiette, Sr. et al. | |
| 5,212,848 | A | 5/1993 | Geyer | |

(Continued)

FOREIGN PATENT DOCUMENTS

JP 10033438 A * 2/1998

(Continued)

*Primary Examiner*—Terrence R. Till
(74) *Attorney, Agent, or Firm*—Alan Kamrath; Kamrath & Associates PA

(57) ABSTRACT

A squeegee assembly (60) includes first and second protrusions (314) interconnected to a support (172) to which front and rear flexible blades (170*a*, 170*b*) are mounted. In preferred aspects, squeegee assembly (60) is of a curved design such that the flexible blades (170*a*, 170*b*) are spaced at the center of the support (172) where a suction tube (174) is provided and taper towards each other so that their ends are closely adjacent each other. The first and second protrusions (314) define upper and lower channel portions (324, 326) between the flexible blades (170*a*, 170*b*) so that appreciable reduction in the speed of air flow towards the suction tube (174) does not occur, which reduction may result in dropping of carried moisture.

20 Claims, 2 Drawing Sheets

U.S. PATENT DOCUMENTS

| | | | | |
|---|---|---|---|---|
| 5,579,555 | A | | 12/1996 | Pearse |
| 5,911,260 | A | * | 6/1999 | Suzuki ..... 15/401 |
| 5,918,346 | A | | 7/1999 | Suzuki |
| RE36,565 | E | | 2/2000 | Burgoon et al. |
| 6,047,437 | A | | 4/2000 | Suzuki |
| 6,108,859 | A | | 8/2000 | Burgoon |
| 6,279,198 | B1 | | 8/2001 | Martin et al. |
| 6,397,429 | B1 | | 6/2002 | Legatt et al. |
| 6,519,808 | B2 | | 2/2003 | Legatt et al. |

FOREIGN PATENT DOCUMENTS

| | | | |
|---|---|---|---|
| WO | WO 94/06344 | * | 3/1994 |

* cited by examiner

SQUEEGEE ASSEMBLY

CROSS REFERENCE

The present application claims the benefit of U.S. Provisional Appln. Ser. No. 60/453,007 filed Mar. 7, 2003.

BACKGROUND

The present application generally relates to squeegee assemblies and specifically to squeegee assemblies having improved pickup.

The use of squeegee assemblies for wiping a surface and collecting dirty solution is conventional in many applications including but not limited to floor surface cleaning machines such as floor scrubbers. Ideally, the blades of the squeegee assembly are always in full contact with the floor surface and any moisture on the floor surface is exposed to, picked up and carried by air flow in the squeegee assembly. The floor surface plays a major factor in the ability of the squeegee assembly to function as desired. Squeegee assemblies function ideally with a level, smooth floor surface. However, floor surfaces are of a variety of types which are not level and/or completely smooth such as by design as in the case of grouted tile or textured floors, by necessity or damage such as in the case of seams and/or cracks, by wear such as rough or pitted surfaces, and the like. In those instances, moisture can be located in depressions which can be easily past over by the blades and/or not exposed to air flow sufficient to be picked up thereby. One manner of overcoming this deficiency is to increase the vacuum pump capabilities, but this is costly and may not be possible due to increased power demands.

Thus, there is a need for an improved squeegee assembly which has improved pickup capabilities.

SUMMARY

The present invention solves this need and other problems in the field of squeegee assemblies by providing, in the most preferred form, a squeegee assembly having improved air flow and particularly balanced air flow between the suction tube and channels created between the squeegee blades. In preferred aspects, an upper channel portion is defined by trailing surfaces of first and second protrusions on a support upon which front and rear flexible blades are mounted in a spaced relation and by the rear flexible blade. The upper extent of the upper channel portion is vertically spaced from the free edges of the front and rear flexible blades greater than lower surfaces of the first and second protrusions. The first and second protrusions are located on opposite sides of a suction tube provided in the support.

Thus, the present invention provides a novel squeegee assembly.

Further, the present invention provides such a novel squeegee assembly with improved pickup on rough surfaces.

Further, the present invention provides such a novel squeegee assembly with improved pickup on grouted tile or textured surfaces.

Further, the present invention provides such a novel squeegee assembly with improved pickup over seams and cracks in the surface.

Further, the present invention provides such a novel squeegee assembly with improved pickup on pitted surfaces.

Further, the present invention provides such a novel squeegee assembly having improved air flow.

Further, the present invention provides such a novel squeegee assembly having balanced air flow to the suction tube from between the squeegee blades.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
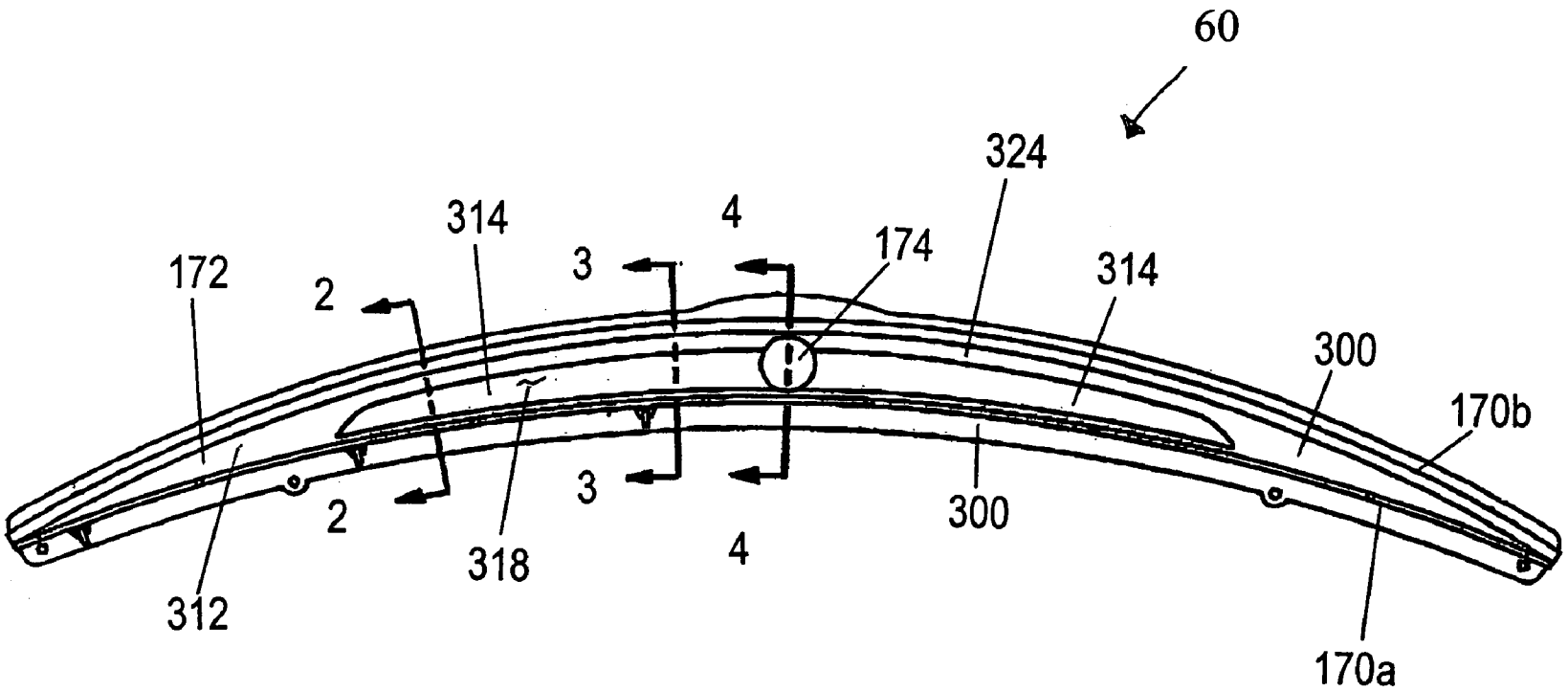
FIG. 1 shows a bottom view of a squeegee assembly according to the preferred teachings of the present invention.
Figures 2, 3, 4, 5:
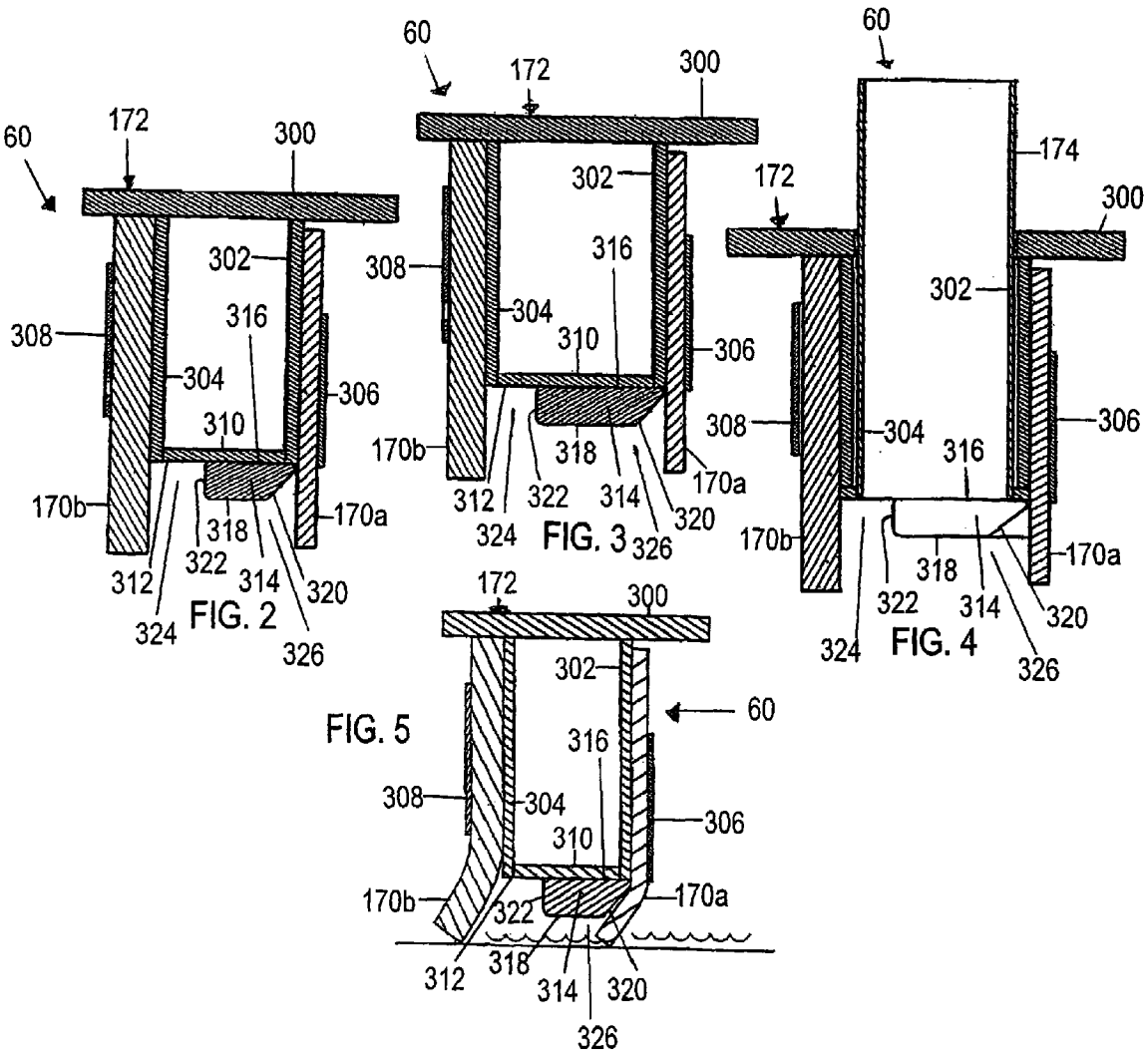
FIG. 2 shows a cross section view of the squeegee assembly of FIG. 1 according to section line 2-2 of FIG. 1.
FIG. 3 shows a cross section view of the squeegee assembly of FIG. 1 according to section line 3-3 of FIG. 1.
FIG. 4 shows a cross section view of the squeegee assembly of FIG. 1 according to section line 4-4 of FIG. 1.
FIG. 5 shows a cross section view of the squeegee assembly of FIG. 1 similar to FIG. 2 but in an operating mode.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", "upper", "lower", "first", "rear", "back" and similar terms are used herein, it should be understood that these terms have reference only to the structure shown in the drawings as it would appear to a person viewing the drawings and are utilized only to facilitate describing the preferred embodiment.

DESCRIPTION OF THE PREFERRED EMBODIMENT

A squeegee assembly for wiping a surface and collecting dirty solution for vacuum pickup according to the preferred teachings of the present invention is shown in the drawings and generally designated 60. Squeegee assembly 60, in the preferred form, can be utilized with any surface cleaning machine including but not limited to the floor surface cleaning machine of the type shown in U.S. Pat. Nos. 6,397,429 and 6,519,808, which are hereby incorporated herein by reference. For purposes of explanation of the basic teachings of the present invention, the same numerals designate the same or similar parts in the present figures and the figures of U.S. Pat. Nos. 6,397,429 and 6,519,808. The description of the common numerals and squeegee member 60 may be found herein and in U.S. Pat. Nos. 6,397,429 and 6,519,808, which are hereby incorporated herein by reference.

Squeegee assembly 60 is oriented with respect to the forward movement direction such that solution tends to be pushed in front of squeegee assembly 60 and is not directed to travel past its ends and in the preferred form shown is of a curved design. However, it can be appreciated that the teachings of the present invention may have application to other types of design including but not limited to a straight design.

Generally, squeegee assembly 60 includes front and rear flexible blades 170*a* and 170*b* mounted to a support 172 so that blades 170*a* and 170*b* are spaced at the center and taper towards each other so that the ends are closely adjacent and/or tight against each other in the preferred form shown. The front blade 170*a* has notches or slots in the free edge along its length to allow solution to pass therethrough. Blades 170*a* and 170*b* contact the floor surface. Blades 170*a* and 170*b* are made from suitable material such as gum rubber, neoprene, urethane, or the like.

A suction tube 174 is provided in support 172 in fluid communication between blades 170*a* and 170*b* adjacent the centers thereof and to which a vacuum can be supplied such that air and solution are pulled in through the slots in the front blade 170*a* or pulled from underneath the front blade 170*a* and flow out of tube 174, with the rear blade 170*b* acting as a wiper to leave the floor surface dry. Suction tube 174 is in fluid communication with a recovery tank in turn in fluid communication with a vacuum assembly which draws air from the hollow interior of the recovery tank.

Particularly, in the form shown, support 172 includes a top 300 which in the preferred form can be suitably removably secured to a mount of suitable provisions for operatively engaging squeegee assembly 60 on the floor surface during an operation mode as well as for raising squeegee assembly 60 from the floor surface during a transport or storage mode. In the most preferred form and when fabricated from stock material such as sheet or plate steel, top 300 is formed of a flat plate. However, top 300, the manner of removably securing squeegee assembly 60 to a mount, and/or squeegee assembly 60 can be of a variety of forms and constructions according to the teachings of the present invention.

Support 172 further includes a front 302 and a back 304 which extend generally perpendicular to the surface to be wiped. In the most preferred form, front 302 and back 304 are curved between their ends parallel to the surface to be wiped. The curvature of front 302 is larger than the curvature of back 304. Thus, when the ends of front 302 and back 304 are tight against each other, front 302 and back 304 are spaced at the center and taper towards each other from the center.

Front blade 170*a* abuts with the front surface of front 302 (opposite to back 304) and is suitably removably secured thereto by any manner such as by a clamping band 306 which sandwiches blade 170*a* against front 302. Similarly, rear blade 170*b* abuts with the back surface of back 304 (opposite to front 302) and is suitably removably secured thereto by any suitable manner such as by a clamping band 308 which sandwiches blade 170*b* against back 304. In the preferred form shown, blade 170*a* has a thickness less than blade 170*b* but could have equal thickness or different relative thicknesses according to the particular material from which blades 170*a* and 170*b* are formed. Likewise, in an unflexed and vertical position, blade 170*a* has a lower extent elevated above the lower extent of blade 170*b* in the form shown. In the most preferred form, blades 170*a* and 170*b* are reversible so that both elongated edges can be oriented to be the lower wiping edges.

Support 172 includes a bottom 310 extending between front 302 and back 304 in a spaced generally parallel relation to top 300. In the most preferred form, support 172 is hollow for weight reduction reasons for ease of removal and assembly, with front 302, back 304 and bottom 310 formed of plates in the preferred form and interconnected together and with top 300 by welding to allow fabrication from stock material such as sheet or plate steel. However, support 172 according to the preferred teachings of the present invention can be formed in other manners such as by forging or casting and can be of other types.

Bottom 310 has a lower extent which is at multiple levels from the surface to be wiped according to the teachings of the present invention. In the preferred form shown, bottom 310 is formed of three pieces. Specifically, bottom 310 shown includes an interconnect plate 312 which is flat and extending between and interconnecting front 302 and back 304. In the preferred form shown, tube 174 terminates in and has a lower extent generally equal to the lower extent of interconnect plate 312. Bottom 310 in the most preferred form includes first and second protrusions 314 located on opposite sides of tube 174 and intermediate blades 170*a* and 170*b*. In particular, each protrusion 314 includes an upper surface 316 which abuts with the lower extent of plate 312 and a lower surface 318 which in the preferred form is generally flat and parallel to the surface to be wiped. Protrusions 314 each further includes a leading surface 320 which extends linearly from front 302 at a rearward angle in the order of 50° to lower surface 318. Additionally, protrusions 314 each include a trailing surface 322, with the trailing surface 322 extending generally perpendicularly and linearly between surfaces 316 and 318 in the preferred form shown.

In the preferred form shown, protrusions 314 are shown separately formed from plate 312 and are suitably interconnected thereto to form a single component. It can be appreciated that protrusions 314 and plate 312 could be integrally formed as a single, unseparable component according to the teachings of the present invention. However, in one aspect of the present invention, protrusions 314 can be provided as a kit to be added to existing squeegee assemblies to create squeegee assembly 60 according to the teachings of the present invention.

Trailing surfaces 322 of protrusions 314 are each spaced from back 304 and from rear blade 170*b* to define an upper channel portion 324 defined in the preferred form by rear blade 170*b*, plate 312, and trailing surfaces 322. The lower extent of channel portion 324 is coextensive with and in communication with a lower channel portion 326. Channel portion 326 is defined in the preferred form by blades 170*a* and 170*b*, lower surface 318, upper channel portion 324, and the surface to be wiped.

In the most preferred form when blades 170*a* and 170*b* (and front 302 and back 304) taper towards each other in squeegee assembly 60, the total length parallel to the surface to be wiped between the opposite ends of protrusions 314 is generally 60% of the total length between the opposite ends of blades 170*a* and 170*b*. Additionally, in the most preferred form, the width of protrusions 314 between surfaces 320 and 322 decrease from tube 174 or, in other words the horizontal center, outwardly. Thus, in the preferred form, the width of upper channel portion 324 is generally constant from tube 174 outwardly. In the most preferred form, the width of upper channel portion could be of constant dimension and in other forms the widths of upper channel portion 324 and of lower channel portion 326 could have a constant ratio. The width of upper channel portion 324 according to the teachings of the present invention is in the range of 20 to 50 percent of the width of cavity portion 326. In the most preferred form where cavity portion 326 has a width which is greater at the center and tapers to zero at the ends, the width of cavity portion 324 is in the range of 20 to 40 percent of the mean width of cavity portion 326.

When wiping a surface, squeegee assembly 60 is in its operation mode with blades 170*a* and 170*b* floating on the surface and flexed due to the operating pressure of squeegee assembly 60. Further, squeegee assembly 60 is moved on the surface with blade 170*a* located in front of blade 170*b*. As a result, blades 170*a* and 170*b* flex at an obtuse angle generally at the level of interconnect plate 312. It should be appreciated that leading surface 320 creates a space behind blade 170*a* in its unflexed or relaxed, transport or storage mode and into which blade 170*a* is able to flex in the operation mode. In the most preferred form where leading surface 320 is angled and linear, front blade 170*a* in its operation mode is closely adjacent to surface 320 to minimize air flow between surface 320 and blade 170*a*.

In the operation mode and in the preferred form shown, the dimension perpendicularly between the surface to be wiped and surface 318 is less than half and in the most preferred form in the range of 20 to 40 percent of the mean width of cavity portion 326 between blades 170*a* and 170*b* parallel to the surface to be wiped. Similarly, the dimension perpendicularly between the surface to be wiped and surface 318 is less than half and in the most preferred form in the range of 20 to 40 percent of the dimension perpendicularly between the surface to be wiped and interconnect plate 312. The dimensions perpendicular to the surface to be wiped relate to when squeegee assembly 60 is in the operation mode.

In the operation mode and in the most preferred form, the combined cross sectional area of channel portions 324 and 326 adjacent to but on opposite sides of suction tube 174 is generally equal to one-half the cross sectional area of suction tube 174, with the cross section of channel portions 324 and 326 being generally parallel to the forward movement direction of squeegee assembly 60 and generally perpendicular to blades 170*a* and 170*b* and with the cross section of suction tube 174 being parallel to the surface to be wiped of the preferred form shown where tube 174 extends generally perpendicular to the surface to be wiped.

Now that the basic construction of squeegee assembly 60 according to the preferred teachings of the present invention has been set forth, the operation and some of the advantages of squeegee assembly 60 can be highlighted. Specifically, during operation of a cleaning machine including squeegee assembly 60, generally a solution is applied to the surface and worked on the floor surface such as by scrubbing brushes. As the cleaning machine is moved forward, blade 170*a* passes over the surface which had been previously worked, with blade 170*a* allowing solution to enter squeegee assembly 60 and to be located between blades 170*a* and 170*b*. Air is drawn from between and along blades 170*a* and 170*b*, through suction tube 174 and into the reservoir. According to the preferred teachings of the present invention, squeegee assembly 60 has improved air flow therethrough. Particularly, it should be appreciated that without protrusions 314 according to the present invention and where blades 170*a* and 170*b* taper toward each other, the area perpendicular to the air flow increases considerably moving from the ends of blades 170*a* and 170*b* towards suction tube 174. As a result, the speed of the air flow decreased approaching suction tube 174 and the air flow had difficulty picking up and/or conveying solution adjacent to suction tube 174 especially where the solution was located in depressions in the floor surface such as in seams, cracks, pits, tile grout grooves, textured areas, roughened areas, and the like.

Protrusions 314 generally reduce the cross sectional area perpendicular to blades 170*a* and 170*b* over approximately 60% of the length of blades 170*a* and 170*b* so that the speed of the air flow does not decrease appreciably as it approaches suction tube 174. Additionally, due to the cross section area of suction tube 174 and thus of air flow therethrough being generally equal to the combined cross sectional areas of channel portions 324 and 326 adjacent to and on opposite sides of suction tube 174, appreciable reduction in the speed of the air flow does not occur, which reduction may result in dropping of carried moisture.

Further, protrusions 314 are located in the opposite corner from where blade 170*b* engages the floor surface to increase air flow adjacent to the lower edge of blade 170*b* where the solution is being collected and to decrease turbulence in the air flow.

Squeegee assembly 60 according to the teachings of the present invention has improved air flow over prior squeegee assemblies and specifically with balanced air flow through squeegee assembly 60 between suction tube 174 and channel portions 324 and 325 and between blades 170*a* and 170*b*. Thus, squeegee assembly 60 has improved pickup, especially from rough surfaces, grouted tile or textured surfaces, cracks and seams in surfaces, pitted surfaces and the like.

Now that the basic teachings of the present invention have been explained, many extensions and variations will be obvious to one having skill in the art. For example, although the shape of protrusions 314 as shown and described is believed to produce synergistic results, protrusions 314 can have other shapes and configurations according to the teachings of the present invention. As an example, trailing surface 322 could be in the form of a compound curve to minimize air turbulence, could be flat of an angled configuration, and the like.

Likewise, although tube 174 in the preferred form has an equal lower extent and terminates in lower plate 312, tube 174 can terminate at other locations and with unequal lower extents according to the teachings of the present invention including but not limited to terminating with respect to protrusions 314.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Squeegee assembly for wiping a surface, with the squeegee assembly comprising, in combination: a front flexible blade; a rear flexible blade, with each of the front and rear flexible blades including a free edge for contacting the surface and including first and second ends; a support upon which the front and rear flexible blades are mounted; and a suction tube provided in the support, with the suction tube extending between the front and rear flexible blades which are spaced by the support, with the support further including first and second protrusions each including a trailing surface and a lower surface, with the trailing surfaces being spaced from the rear flexible blade to define an upper channel portion having an upper extent, with the upper extent of the upper channel portion being vertically spaced from the free edges of the front and rear flexible blades greater than the lower surface, with the first and second protrusions located on opposite sides of the suction tube.

2. The squeegee assembly of claim 1 with the first and second protrusions each including a leading surface, with the front flexible blade abutting with the leading surface in an operation mode.

3. The squeegee assembly of claim 2 with the leading surface extending linearly to the lower surface at an angle in the order of 130°.

4. The squeegee assembly of claim 3 with the trailing surface extending generally perpendicularly and linearly from the lower surface.

5. The squeegee assembly of claim 4 with the first and second protrusions being separately formed from the support and interconnected to the support to form a single component.

6. The squeegee assembly of claim 5 with the support including a bottom to which the first and second protrusions are interconnected, a front, and a back, with the bottom extending between the front and the back, with the front flexible blade abutting with and removably secured to the front, with the rear flexible blade abutting with and removably secured to the back, with the leading surface extending linearly from the front, with the trailing surface located intermediate the front and the back.

7. The squeegee assembly of claim 6 with the support further including a top, with the top extending between the front and the back, with the support being hollow for weight reduction.

8. The squeegee assembly of claim 6 with the suction tube terminating in and having a lower extent generally equal to a lower extent of the bottom.

9. The squeegee assembly of claim 2 with a width defined between the leading and trailing surfaces of the first and second protrusions decreasing from the suction tube outwardly.

10. The squeegee assembly of claim 1 with the front and rear flexible blades tapering towards each other from the suction tube towards the ends.

11. The squeegee assembly of claim 10 with the first ends of the front and rear flexible blades being closely adjacent each other and the second ends of the front and rear flexible blades being closely adjacent each other.

12. The squeegee assembly of claim 11 with the first and second protrusions each having an end opposite the suction tube, with a length defined between the ends of the first and second protrusions being generally 60% of a length between the first and second ends of the front and rear flexible blades.

13. The squeegee assembly of claim 12 with the upper channel portion having a width parallel to the surface and perpendicular to the front and rear flexible blades of a constant dimension.

14. The squeegee assembly of claim 11 with the front flexible blade having a thickness less than that of the rear flexible blade.

15. The squeegee assembly of claim 11 with the upper channel portion having a width parallel to the surface and perpendicular to the front and rear flexible blades in the range of 20 to 50% of a width between the front and rear flexible blades and perpendicular to the front and rear flexible blades.

16. The squeegee assembly of claim 10 with the upper channel portion having a width parallel to the surface and perpendicular to the front and rear flexible blades in the range of 20 to 40% of a mean width between the front and rear flexible blades and perpendicular to the front and rear flexible blades.

17. The squeegee assembly of claim 16 with the lower surface being in a range of 20 to 40% of a distance as the upper extent is from the surface in an operation mode.

18. The squeegee assembly of claim 1 with a cross section area between the front and rear flexible blades and between the support and the surface being generally equal to one-half of a cross sectional area of the suction tube parallel to the surface.

19. The squeegee assembly of claim 1 with the upper channel portion having a width parallel to the surface and perpendicular to the front and rear flexible blades of a constant dimension.

20. The squeegee assembly of claim 1 with the lower surface being in a range of 20 to 40% of a distance as the upper extent is from the surface in an operation mode.

* * * * *